US005876239A

United States Patent [19]

Morin et al.

[11] Patent Number: 5,876,239

[45] Date of Patent: Mar. 2, 1999

[54] ELECTRICAL CONNECTOR HAVING A LIGHT INDICATOR

[75] Inventors: Scott Frederick Morin, San Jose; Brian Patrick Costello, Redwood City, both of Calif.; Michael Paul Derstine, Winston-Salem, N.C.

[73] Assignee: The Whitaker Corporation, Wilmington, Del.

[21] Appl. No.: 707,169

[22] Filed: Aug. 30, 1996

[51] Int. Cl.[6] ..... H01R 3/00

[52] U.S. Cl. ..... 439/490

[58] Field of Search ..... 439/488, 490, 439/489; 362/26, 27, 32

[56] References Cited

U.S. PATENT DOCUMENTS

| | | | |
|---|---|---|---|
| 4,069,403 | 1/1978 | Beaudette et al. | 200/51.12 |
| 4,379,606 | 4/1983 | Clark et al. | 338/17 CF |
| 4,397,513 | 8/1983 | Clark et al. | 339/91 R |
| 4,404,522 | 9/1983 | Pucciarello | 324/114 |
| 4,431,966 | 2/1984 | Pucciarello | 324/114 |
| 4,445,164 | 4/1984 | Giles, III et al. | 362/311 |
| 4,772,219 | 9/1988 | Falchetti | 439/490 |
| 4,789,224 | 12/1988 | Bougsty | 350/345 |
| 4,815,993 | 3/1989 | Falchetti | 439/622 |
| 4,924,213 | 5/1990 | Decho al. | 340/653 |
| 4,978,317 | 12/1990 | Porcrass | 439/490 |
| 5,146,620 | 9/1992 | Swikle et al. | 455/351 |
| 5,188,542 | 2/1993 | Ballman | 439/620 |
| 5,191,461 | 3/1993 | Cranshaw et al. | 359/154 |
| 5,320,560 | 6/1994 | Fladung | 439/490 |
| 5,327,328 | 7/1994 | Simms et al. | 362/26 |
| 5,339,178 | 8/1994 | Phelps, III et al. | 359/42 |
| 5,349,504 | 9/1994 | Simms et al. | 362/32 |
| 5,359,492 | 10/1994 | Porter | 361/683 |
| 5,466,174 | 11/1995 | Savage, Jr. | 439/596 |
| 5,470,252 | 11/1995 | Flaudung | 439/490 |
| 5,555,161 | 9/1996 | Roe et al. | 362/32 |
| 5,567,175 | 10/1996 | Warden et al. | 439/490 |
| 5,601,451 | 2/1997 | Driones et al. | 439/490 |
| 5,613,873 | 3/1997 | Bell, Jr. | 439/490 |
| 5,700,157 | 12/1997 | Chung | 439/490 |

FOREIGN PATENT DOCUMENTS

| | | |
|---|---|---|
| 315705 A1 | 5/1989 | European Pat. Off. . |
| 365698 | 5/1990 | European Pat. Off. . |
| 3005652 B1 | 4/1981 | Germany . |

OTHER PUBLICATIONS

U.S. application No. 08/453,729 filed May 30, 1995 (Abstract and Drawings only included).

*Amphenol Brochure,* "RJHS Single Port High Speed RJ–45 Modular Jack," one page, date unknown; Amphenol Canada Corp.

*Maxconn Brochure,* "Modular Jack Connectors, MLJ Series . . . " one page, date unknown; Maxconn Inc., San Jose, CA.

International Search report Dated Jan. 9, 1998/PCT/US 97/14844.

*Primary Examiner*—Paula Bradley
*Assistant Examiner*—Yong Ki Kim
*Attorney, Agent, or Firm*—Salvatore Anastasi

[57] ABSTRACT

This invention provides a modular jack receptacle connector (10) which has at least one light pipe (14) for transmitting light signals from a light emitting device receiving area (66) through an output face (76) along the mating face (24) of the modular jack receptacle (10).

13 Claims, 7 Drawing Sheets

ELECTRICAL CONNECTOR HAVING A LIGHT INDICATOR

FIELD OF THE INVENTION

This invention relates to electrical connectors and more particularly to electrical connectors having a light indicator.

BACKGROUND OF THE INVENTION

Modular jack receptacle connectors are well known in the telecommunications industry and have been adapted for mounting to printed circuit boards. These connectors are typically used for electrical connection between two electrical communication devices. In order to ensure that a proper connection has been made and therefore a link is created between the electrical communication devices, indicators are often incorporated into circuits on the printed circuit board. These indicators are typically light emitting diodes (LEDs) which are turned on when a circuit is completed between the mating connectors and the communication devices. Additionally LEDs can be mounted on the printed circuit board to indicate a number of other conditions including the passage of communications signals between the two communication devices, indication of power, or indication that an error in transmitting the signals has occurred.

In an effort to miniaturize printed circuit boards and save board real estate, LED indicators have been integrated into these connectors. An example of such a connector is disclosed in U.S. Pat. No. 4,978,317 to Pocrass which teaches a connector for receiving a plug having a visual indicator positioned within the front wall of the electrical connector housing. Incorporation of the indicator into the electrical connector eliminates the need for a separate location on the printed circuit board for mounting of such an indicator. The LED indicator is inserted into a recess of the electrical connector such that its electrical leads pass through the recess and connect to the printed circuit board. The indicator is then cemented into the recess or attached using an appropriate adhesive. The LEDs may also be molded into the electrical connector during the molding process of the housing.

Keeping in mind the desire to save board real estate by incorporation of the indicator into the electrical connector, a problem arises with these connectors in that additional manufacturing steps are required for insertion and accurate positioning of the LEDs for mounting to corresponding openings in the printed circuit board. These additional manufacturing steps include first accurately positioning the LED in a recess of the connector and also securing the LED thereto by either cementing or otherwise adhering the LEDs to the housing. Also, for identification purposes, LEDs must be manufactured with the component being overmolded by a colored translucent material and having leads attached thereto for connection to the circuit board.

SUMMARY OF THE INVENTION

It is therefore an object of this invention to provide a modular jack receptacle connector suitable for mounting to a printed circuit board having provision to transmit a light signal from the surface of a printed circuit board where a light emitting device is mounted to a visible surface of the electrical connector, for example the mating face.

The object of the invention has been achieved by providing a modular jack connector suitable for mounting to a printed circuit board having an indicator receiving area disposed along a circuit board mounting face, and a light transmission medium extending from the indicator receiving area to a visible surface of the electrical connector, for example the mating face.

BRIEF DESCRIPTION OF THE DRAWINGS

The invention will now be described by way of example with reference to the following figures of which.

DETAILED DESCRIPTION OF THE INVENTION

Figure 1:
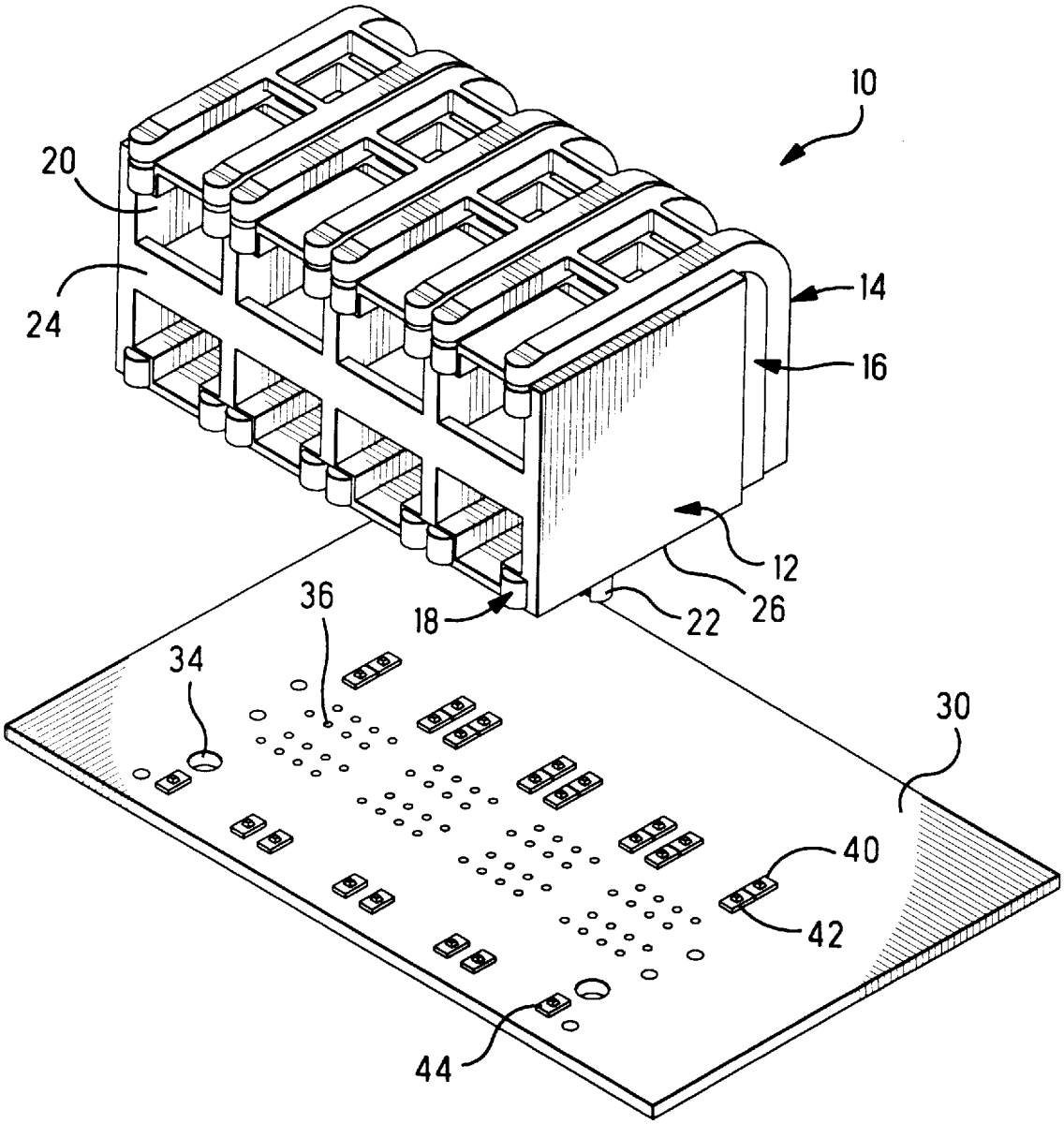
FIG. 1 shows a three-dimensional view of the modular jack receptacle connector above a printed circuit board.

The modular jack receptacle connector 10 of the present invention will now be described generally with reference to FIG. 1. The modular jack receptacle connector 10 consists of an insulative housing 12 profiled to have a plurality of plug receiving openings 20 for receiving a respective plurality of mating modular jack plugs which are well known in the art and not shown here. For simplicity, the modular jack receptacle connector 10 is shown here without contacts latching means, or an EMI shield which are also well known in the art and typically disposed in each plug receiving opening 20. For example, a typical contact arrangement is shown in the alternate embodiment of FIG. 6. Referring again to FIG. 1, the insulative housing 12 is provided with guide posts 22 for properly aligning the modular jack receptacle connector 10 to a printed circuit board 30. The guide posts are received in openings 34 of the printed circuit board 30. This cooperation serves to align contact tails (not shown) exiting from the board mounting face 26 with openings 36 in the printed circuit board 30. The printed circuit board 30 is prefabricated to have LEDs 40, 42, 44 mounted directly to the circuit board 30 using standard surface mount technology (SMT). Corresponding light pipes 14, 16, 18 are provided on the insulative housing 12 for transmitting the light emanating from the LEDs 40, 42, 44 to the mating face 24 of the modular jack receptacle connector 10.

Figure 2:
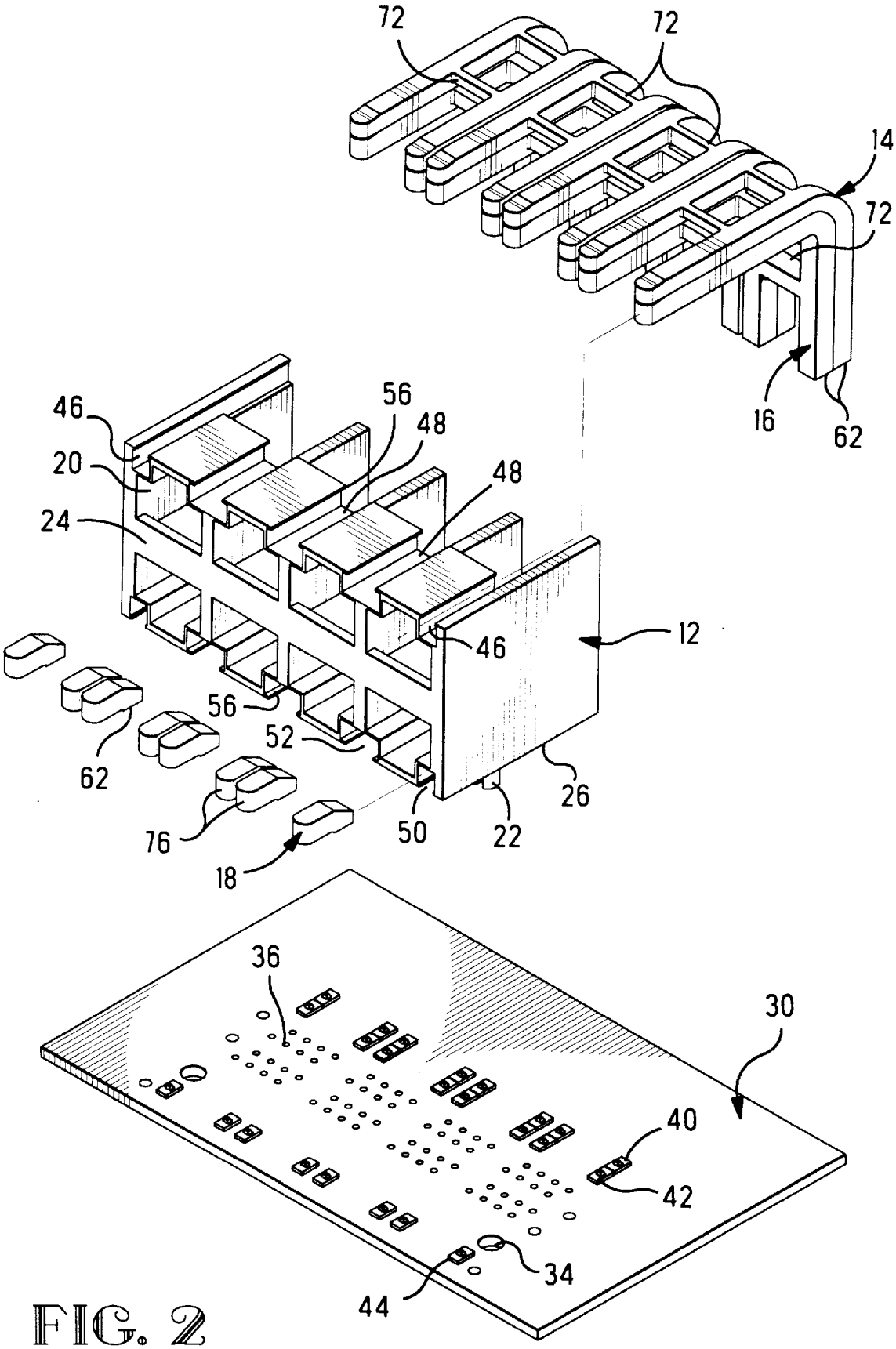
FIG. 2 shows a three-dimensional exploded view similar to that of FIG. 1.

Referring now to FIG. 2, each of the major components will be described in greater detail. The insulative housing 12 is profiled to have a plurality of modular plug receiving openings 20 along its mating face 24. Adjacent to at least one major surface of each modular plug receiving opening 20 is at least one light pipe receiving channel 46, 48, 50, or 52. Each light pipe receiving channel 46, 48, 50, 52 is generally U-shaped and extends from the mating face 24 rearward to a predetermined position corresponding with the position of a respective LED 40, 42, 44 mounted on the printed circuit board 30. Each of the U-shaped channels 46, 48, 50, 52 include retaining ledges 56 disposed along the open side of the U-shaped channel. For simplicity, the electrical contacts are not shown here; however, it is well known that such contacts suitable for making electrical connection to a standard modular jack plug would extend from the modular jack plug receiving opening 20 rearward and then bend at a 90° angle and proceed downward toward the printed circuit board 30 for electrical connection to openings 36 and traces on the printed circuit board 30.

Figure 3:
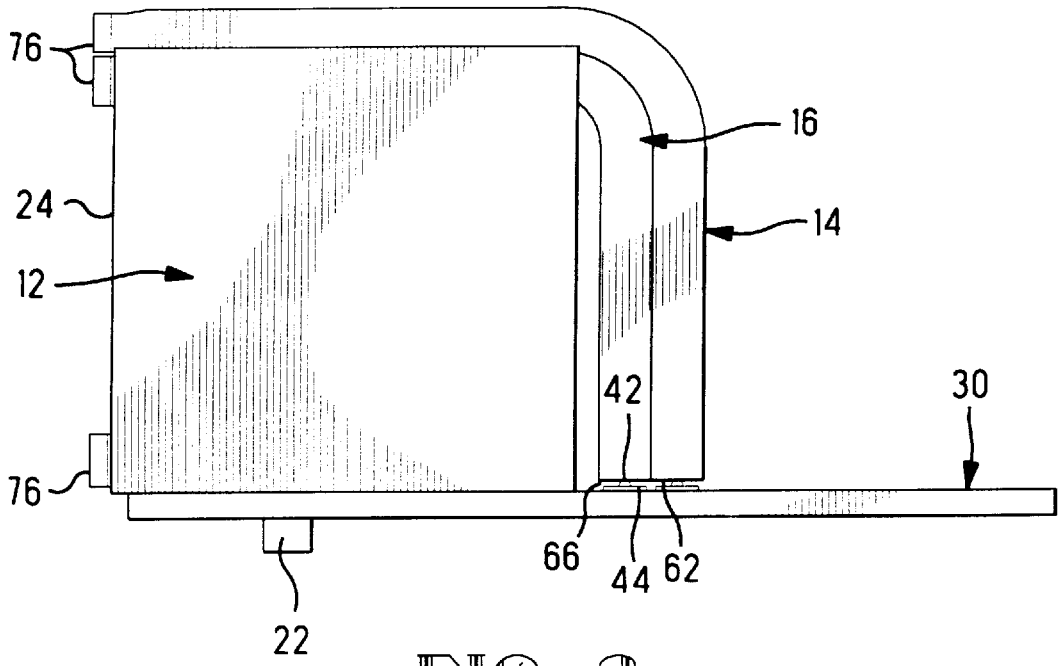
FIG. 3 shows a side view of the modular jack receptacle connector.
Figure 4:
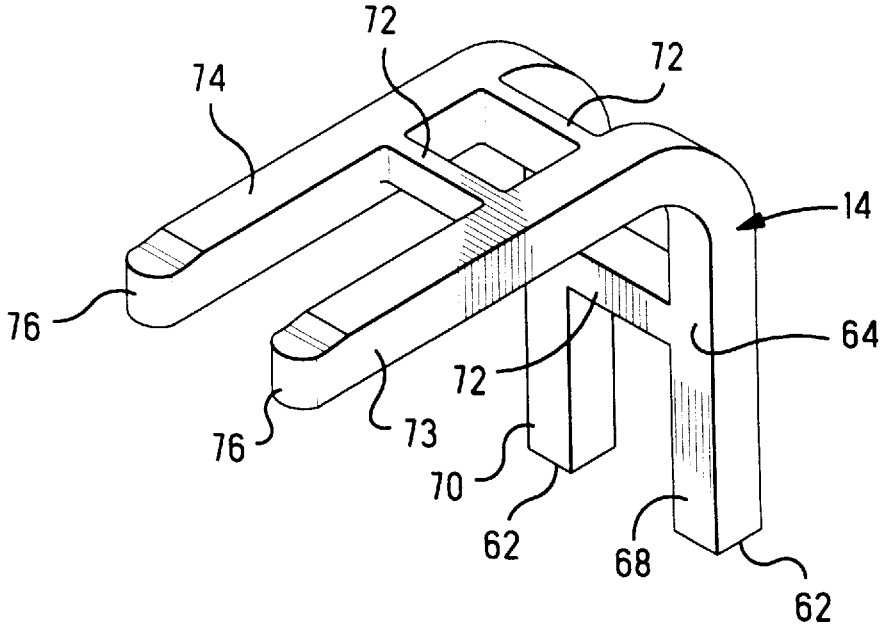
FIG. 4 shows a three-dimensional view of the top light pipe according to this invention.

There are three varieties of light pipes 14, 16, 18 utilized in this modular jack receptacle connector 10. Each will now be described in greater detail with reference to FIGS. 2, 3, and 4. The first light pipe 14 is best shown in FIG. 4 and is manufactured from a translucent material suitable for carrying light, for example a plastic or glass, and may be color coded to distinguish it from the other light pipes 16, 18 incorporated into this receptacle connector 10. The first light pipe 14 is profiled to have input faces 62, four arms 68, 70, 73, 74, cross members 72 and output faces 76. A light emitting device receiving area 66 (FIG. 3) is defined by the space created between the input face 62, and the printed circuit board 30. A similar light emitting device receiving area 66 is also provided at the input faces 62 of the other light pipes 16,18. The first and second light pipes 14, 16 are designed to carry two separate light signals from input faces 62 of first respective arms 68, 70 then through second respective arms 73, 74 to output faces 76. Crossmembers 72 are integrally molded to provide support between the arms 68, 70, 73, 74.

The second light pipe 16 is profiled to fit below the first light pipe 14 and has the same features as the first light pipe 14. The second light pipe 16 is secured to the insulative housing 12 in channels 46, 48.

Finally, the third light pipe 18 has similar features to those described above except that it is designed to carry only one signal and the corresponding first arm 68 is much shorter than the corresponding second arm 73. Like the first light pipe 16, this third light pipe 18 is also secured into the insulative housing 12 within channels 50, 52. Alternatively, this third light pipe 18 could be removed and the respective LED 44 could be positioned to such that light emanating therefrom would be coupled with a translucent part of the mating plug connector, for example the latch. In such an arrangement the latch would act as the light transmitting medium instead of the light pipe 18.

Assembly of the modular jack receptacle connector 10 will now be described referring once again to FIG. 2. Electrical contacts (not shown) are first inserted into the insulative housing using well-known conventional techniques. Light pipes 18 are inserted into channels 50, 52 along the mating face 26 of the insulative housing 12. The third light pipes 18 may have an adhesive applied thereto for securing them into respective channels 50, 52. Alternatively, known latching or detent features may be incorporated into the side surfaces of the light pipes 14,16,18 and complementary features may be incorporated into the sidewalls of the channels 46, 48, 50, 52 to secure the light pipes without adhesive. The second light pipes 16 are then inserted into channels 46, 48 from the rear end of the insulative housing 12 and similarly secured by either adhesive or latching features. The receptacle connector 10 may then be mounted to a printed circuit board 30 such that alignment posts 22 correspond with openings 34 and respective LEDs 42, 44 are received in the light-emitting device receiving areas 66. Finally, the first light pipes 14 may be mounted and secured by adhesively attaching them to the second light pipes 16. Alternatively, the first and second light pipes 14,16 may be premolded together to eliminate the need for adhesive attachment.

Figure 5:
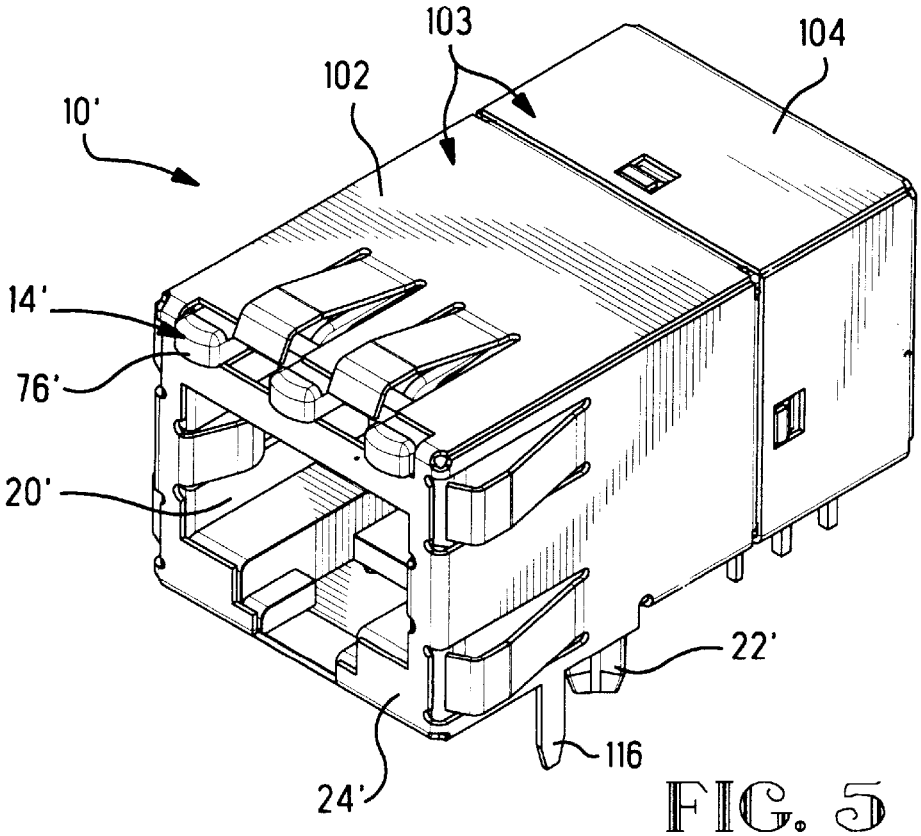
FIG. 5 shows a three-dimensional view of an alternate modular jack receptacle connector according to this invention.
Figure 7:
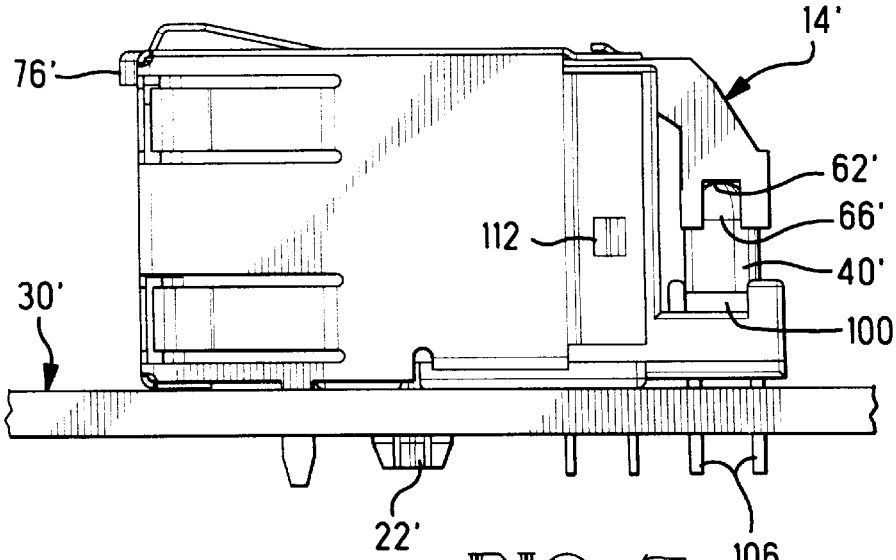
FIG. 7 shows a side view of the alternate modular jack receptacle connector shown in FIGS. 5 and 6.
Figure 6:
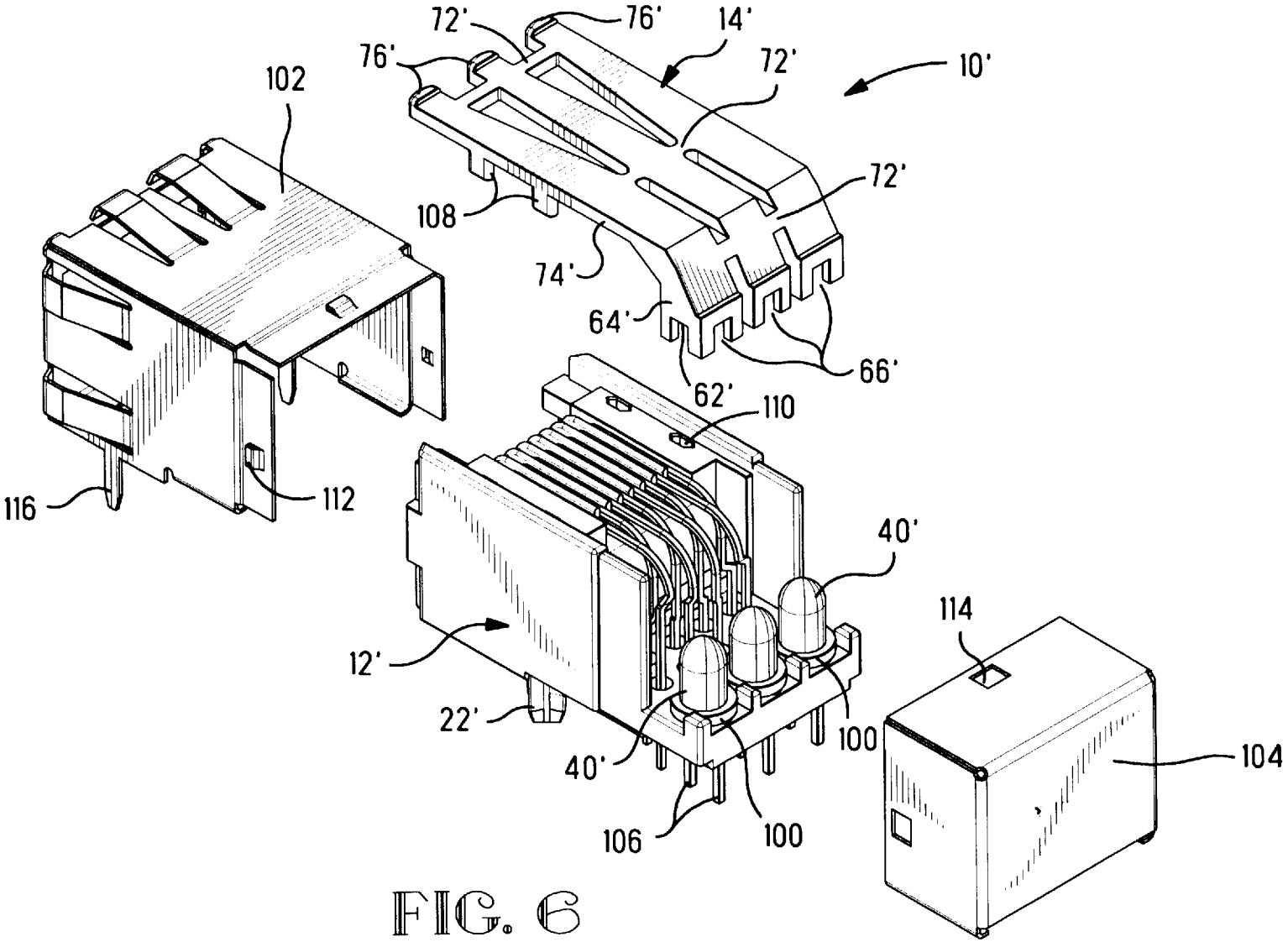
FIG. 6 shows a exploded three-dimensional view of the alternate modular jack receptacle connector of FIG. 5

An alternate embodiment of the present invention will now be described with reference to FIGS. 5–7. Similar numbers for similar features will be used adding a "'" for the alternate embodiment The alternate modular jack receptacle connector 10' is profiled with a single modular plug receiving opening 20' for receiving a single modular jack plug not shown. This modular receptacle connector 10' is similar to that of FIGS. 1–5 in that it provides a light pipe 14' for transmitting light from the light emitting devices 40' disposed in light-emitting device receiving areas 66' to the mating face 24' of the receptacle connector 10'. The insulative housing 12' is provided with LED mounting areas 100 along the rear end thereof Each LED 40' may be color coded to distinguish it from adjacent LED signals. The LEDs 40' of this embodiment have leads 106 extending therefrom for electrical connection to the printed circuit board.

Light is transmitted from the LEDs to a series of input faces 62' through a respective series of first arms 64' then through a respective series of second arms 72' to the output faces 76'. Cross members 72' are also provided here for supporting adjacent arms 62', 72'. The light pipe 14' is secured to the insulative housing 12' by the cooperation of insertion tabs 108 with respective openings 110. An EMI shield 103 is provided around the entire insulative housing 12' and consists of a front half shell 102 and a rear half shelf 104 which are secured to each other by the cooperation of tabs 112 with openings 114. The EMI shield 103 may be electrically connected to a circuit on the printed circuit board via posts 116 which extend therefrom.

Figure 8:
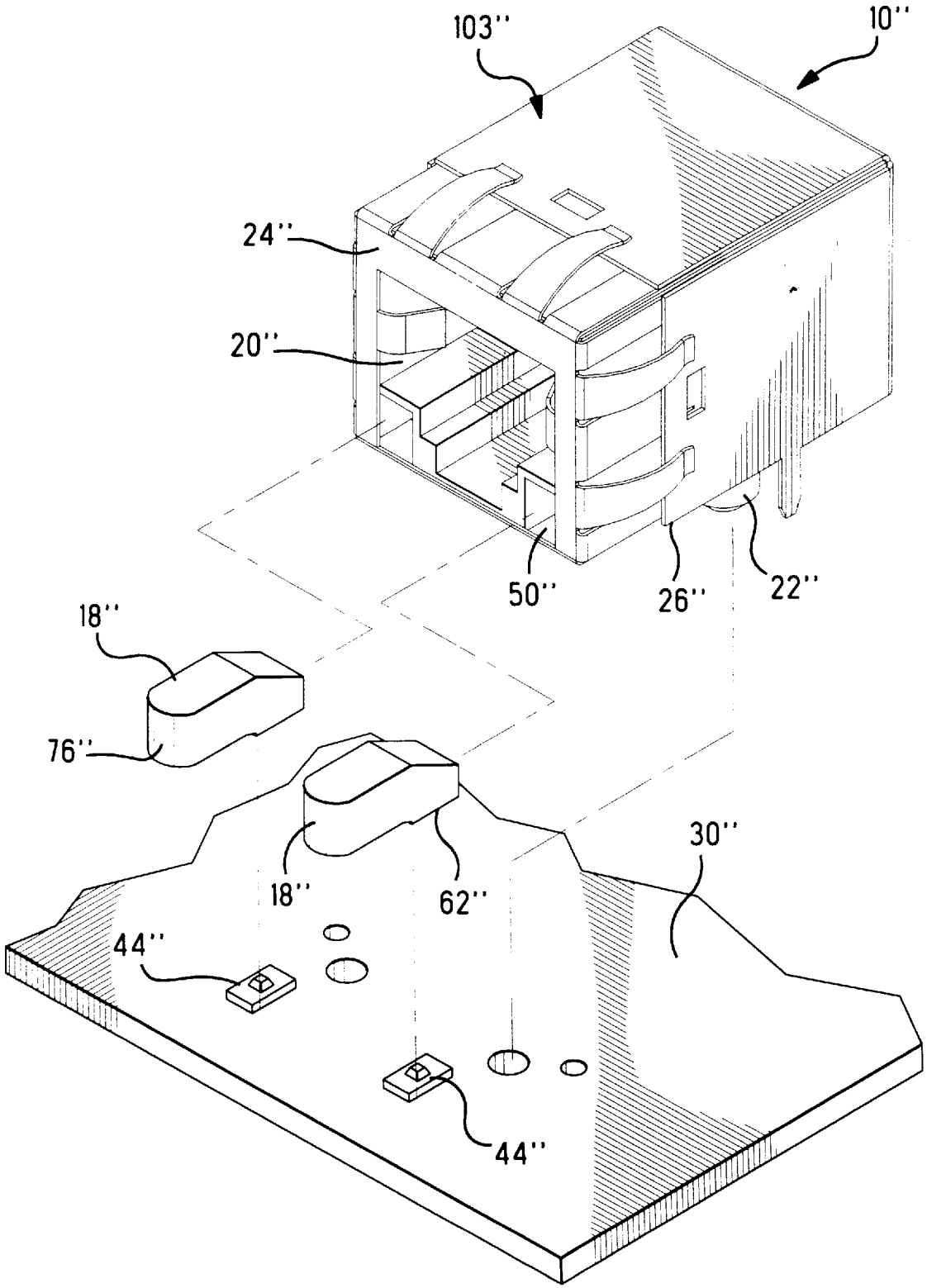
FIG. 8 shows a three-dimensional exploded view of a second alternate single modular jack receptacle.

Referring to FIG. 8, a second alternate embodiment of the modular jack receptacle connector 10" is shown. This embodiment will be described using the same reference numerals for similar features with the addition of a "'". This second alternate embodiment shows the modular jack receptacle connector 10" having a single plug receiving opening 20" and light pipes 18" mounted along the mating face 24" closest to the board mounting face 26" Light pipes 18" are similarly secured into channels 50" and are aligned with corresponding LEDs 44" mounted on a printed circuit board 30" by SMT, The light pipe 18" is profiled for transmitting light from the LED 44" through an input face 62" to an output face 76". This single modular jack receptacle connector 10" is also provided with an EMI shield 103" similar to that the second alternate embodiment 10". An alignment post 22" is also provided for alignment to the printed circuit board 30".

Figure 9:
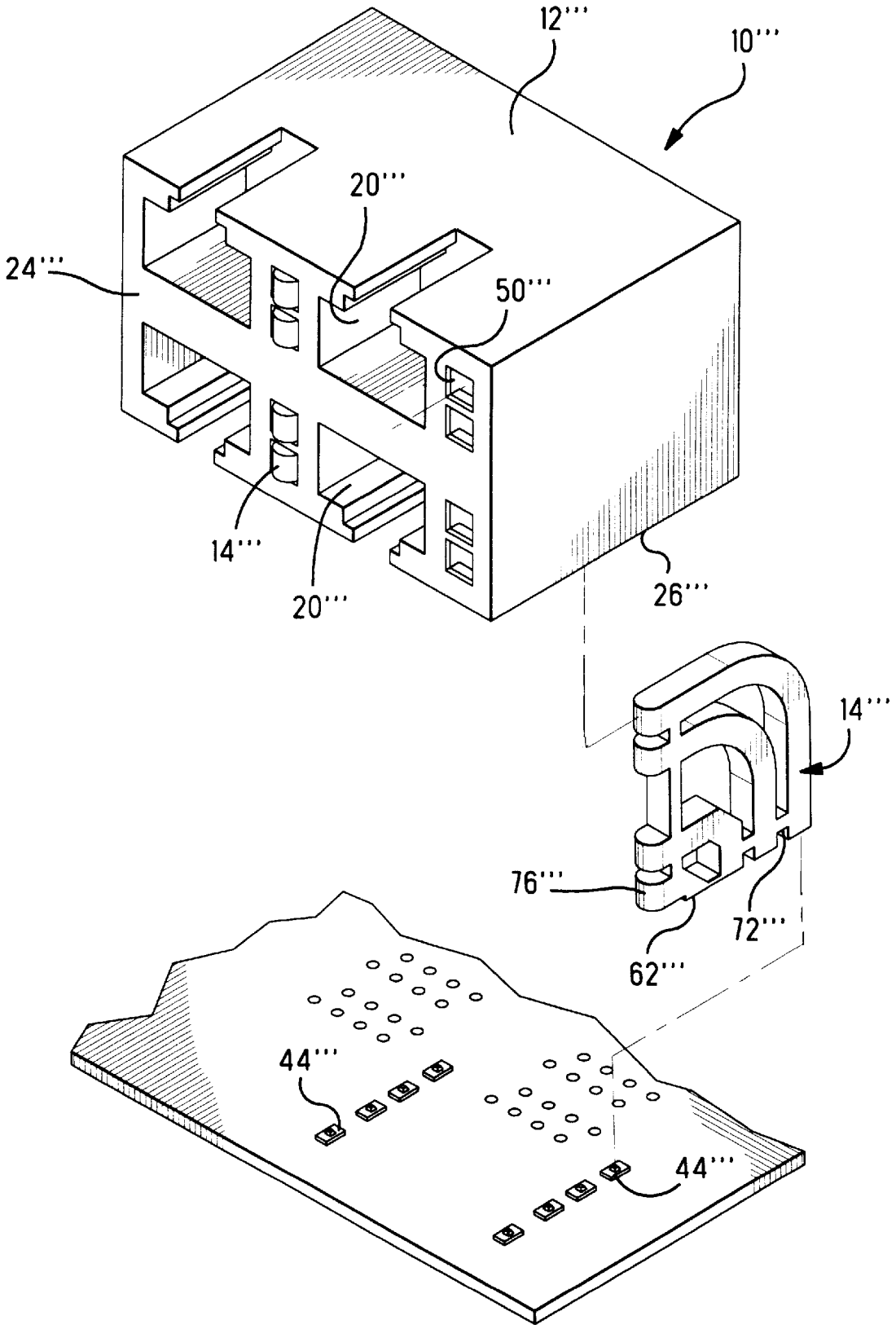
FIG. 9 shows a three-dimensional exploded view of a third alternate modular jack receptacle.

FIG. 9 shows a third alternate embodiment of the modular jack receptacle connector 10'". Similar features will have similar reference numerals with the addition of a "'" for this embodiment. This embodiment is profiled to have a plurality of plug receiving openings 20'" and channels for receiving light pipes 14'" such that the output faces 76'" show through openings of the channel 50'" along the mating face 24'". Similarly light travels from the LEDs 44'" through the input faces 62'" to the output faces 76'" of the light pipe 14'". The advantage of this embodiment is that by placing the channels 50'" and light pipe 14'" between adjacent plug receiving openings 20'", the overall height of the modular jack receptacle connector 10'" is reduced. This embodiment is shown with the light pipe 14'" having cross members 72'" similar to that of the earlier embodiments. However, the light pipe 14'" could be fabricated without cross members 72'" such that four separate light pipes each having two arms would result.

Each of the four resultant light pipes could then be placed into constant radius cavities similar to the channels 50''' and may be inserted from the board mounting face 26'''.

It should be understood that the features shown in each of the two embodiments may be combined in other ways to achieve a desired result. For example, an EMI shield 103 may be provided for the modular jack receptacle connector 10. Also the light pipes 14, 16, 18 designed for carrying light from a surface mounted LED 40, 42, 44 may be incorporated into various modular jack receptacle connector configurations, for example, higher stacked rows or more columns of plug receiving openings. Other variations and combinations of features would be obvious to the reasonably skilled artisan and are within the spirit of this invention.

An advantage of this invention is that the manufacturing steps of producing an overmolded LED having leads, and accurately mounting of such an LED into a housing are eliminated.

Another advantage of this invention is that surface mounted LED's 40, 42, 44 generating noise signals are farther apart from the contacts 16 of the modular jack receptacle connector 10 than those of the prior art. They are therefore less likely to cause noise interference with communications signals passing through the modular jack plug and receptacle 10 connectors.

We claim:

1. A board mountable electrical connector having a circuit board mounting face, and a mating face comprising:

a plurality of indicator receiving areas disposed along the circuit board mounting face, and;

a plurality of light transmission media extending from the indicator receiving areas to the mating face, at least one of the light transmission media being color coded to be a different color from the other light transmission media, whereby light is transmitted from a respective light emitting device mounted on the circuit board to respective positions on the mating face of the electrical connector.

2. An electrical connector as recited in claim 1 wherein the light transmitting medium is a glass material.

3. An electrical connector as recited in claim 1 wherein the light transmitting medium is a plastic material.

4. A board mountable electrical connector having a circuit board mounting face, and plurality of major surfaces, comprising:

an indicator receiving area disposed alone the circuit board mounting face, and;

a plurality of light transmitting media extending from the indicator receiving area to one of a plurality of major surfaces, at least one of the light transmitting media being color coded to be a different color from the other light transmitting media whereby light is transmitted from a light emitting device mounted on the circuit board to the major surface.

5. An electrical connector as recited in claim 4 wherein the light transmitting medium is a glass material.

6. An electrical connector as recited in claim 4 wherein the light transmitting medium is a plastic material.

7. An electrical connector being mountable to a printed circuit board having an insulative housing profiled to receive a complimentary connector, the electrical connector comprising:

a channel formed in the insulative housing and extending from a mating face to a board mounting face, and;

a light transmission medium disposed inside the channel and profiled to have an input face positioned near the board mounting face and an output face positioned along the mating face of the insulative housing.

8. The electrical connector as recited in claim 7 wherein the insulative housing further comprises an indicator receiving area disposed along the circuit board mounting face adjacent the input face of the light transmission medium.

9. The electrical connector as recited in claim 7 whereby the light transmission medium is a plastic lightpipe.

10. The electrical connector as recited in claim 7 wherein the light transmission medium is a glass lightpipe.

11. The electrical connector as recited in claim 7 wherein the light transmission medium is color coded.

12. The electrical connector as recited in claim 7 wherein the light transmission medium is secured to the insulative housing by latching means.

13. The electrical connector as recited in claim 7 wherein the light transmission medium is secured to the insulative housing by an adhesive disposed inside the channel.

* * * * *